US007048232B1

(12) United States Patent
Plottner

(10) Patent No.: US 7,048,232 B1
(45) Date of Patent: May 23, 2006

(54) PLOTTNER ROTOR KITE

(76) Inventor: Jarl Vernon Plottner, 1106 Field St. NW., Canton, OH (US) 44709

( * ) Notice: Subject to any disclaimer, the term of this patent is extended or adjusted under 35 U.S.C. 154(b) by 0 days.

(21) Appl. No.: 10/980,013

(22) Filed: Nov. 3, 2004

(51) Int. Cl.
*B64C 31/06* (2006.01)

(52) U.S. Cl. ..... 244/153 A

(58) Field of Classification Search ..... 244/153 R–155 A; 446/44, 36
See application file for complete search history.

(56) References Cited

U.S. PATENT DOCUMENTS 2,222,402 A * 11/1940 Carrasco ..... 244/153 A
2,442,846 A * 6/1948 Dunn ..... 244/153 A
4,084,345 A * 4/1978 Tanaka ..... 446/44
4,154,017 A * 5/1979 Bilardi et al. ..... 446/36
5,149,020 A * 9/1992 Rundle et al. ..... 244/153 A
5,381,988 A * 1/1995 Kattas ..... 244/153 A
5,556,057 A * 9/1996 Davies ..... 244/153 R
5,996,934 A * 12/1999 Murph ..... 244/17.25

* cited by examiner

*Primary Examiner*—Galen Barefoot

(57) ABSTRACT

A Rotor Kite that is flown by means of two control lines and which has two counter rotating 50 inch rotors and which can be flown in winds of 9 miles per hour and greater. This Rotor Kite can take off, fly in the air at various heights and then be landed by the operator on its rear legs with no harm to the spinning rotors. Manipulation of the Rotor Kite in the air is possible at all times as the two major merits of this invention are its fly ability and its control ability.

3 Claims, 2 Drawing Sheets

PLOTTNER ROTOR KITE

BACKGROUND OF THE INVENTION

This invention of the Plottner Rotor Kite is considered by me to be a model rotor kite and most certainly in its larger possible sizes can not be considered to be a toy as I have observed is used in the name of some other rotating wing type apparatuses named in patent files. Even the rotors on this model rotor kite at times have a very high revolutions per minute and the tip speed of the 50 inch length rotors can be quite dangerous at the higher speeds so I envision it to be difficult to call this invention a toy.

I do believe this invention does fall into the category of a model rotor kite and therefore have given it that name description. There are many rotary wing devices in the patent listings and all of them must overcome the dissymmetry of lift problem that is inherent in a rotating rotor blade. That is the simple fact that any spinning rotor, whether it be on an autogiro that is moving down a runway and therefore has a relative wind to contend with, or if it is a rotor kite that is sitting on the ground ready for takeoff in a wind that is blowing at perhaps 10 miles per hour in velocity, has to contend with the problem of one half of the rotation of a particular rotor will always be going with the wind and the other half of the rotor will be going against the wind and this will create the dissymmetry of lift mentioned above. To overcome this most of the inventions of these kind of flying models use a teetering rotor design which allows the rotor to teeter much like a teeter-totter at a children's playground. This is the arrangement used on the Plottner Rotor Kite but with this invention two counter rotating rotors are used on a single mast and in addition to the teetering action of each rotor the counter revolving of the two rotors also adds to the overcoming of the dissymmetry of lift and adds considerably to the stableness of the complete unit.

Another inherent problem with any rotary wing propelled flyer is the problem of control and many other patents that I have examined claim flight with one control line, much as many ordinary kites are flown. I question whether any of these claims of flight with a single control line are valid except for very short flights of a second or so. I have had first hand experience with a product I purchased several years ago which has a patent number of U.S. Pat. No. 5,381,988. This was a very well made product with the outline of a helicopter fuselage in plastic with a very efficient plastic rotor of perhaps 12 inches in length attached to a metal mast at the top of the fuselage. The rotor on this unit spun up very well in even light winds of 6 miles per hour and it claimed to be able to be controlled with just one control line which was attached to its front center. I flew this model quite often on the beaches at Cape Hatteras where I have done much of my testing but the only time I ever had sustained flight was after I added my own design of two control lines. All of my flights with one control line basically ended in failure while with two lines the craft could be flown for many minutes and actually at times be landed safely. So the idea of control is of great importance for while we want the Plottner Rotor Kite to be completely controllable we also want it to be a challenge to fly and we believe that it is that with its special arrangement of the control lines.

Yet anther flaw in the designs I have studied is often the use of balsa wood in the makeup of the rotor blades. My experience with balsa rotor blades is that they are so dainty that the slightest kind of accident can destroy them completely. The rotor blades used on the Plottner Rotor Kite are made from sturdy yet reasonably light Poplar wood and very easily repaired in most cases with a few dabs of Elmer's glue. It also seems that most of these older patents have weighted rotor blades which means they have a weight someplace near the leading edge of each blade to bring its width wise balance to a point that is approximately 25 percent of the total width of the blade from the leading edge of the blade. We do not question that on full size man carrying rotor blades this is an absolute necessity. But we have found that we do not need this tedious building procedure on our Plottner Rotor Kite.

BRIEF DESCRIPTIN OF THE DRAWINGS

FIG. 1 contains an angled view of the complete invention with all of the major parts visible.

FIG. 2 also contains a drawing in the upper top left portion of the page showing a more detailed view of how the sleeve bearing (which is attached to the rotor hub) is held onto the Mast of the unit.

FIG. 3 contains a drawing in the upper right portion of the page showing the details of the fitting that holds the Mast and attaches to the Base of the unit.

DETAILED DESCRIPTION OF THE INVENTION

Figure 2:
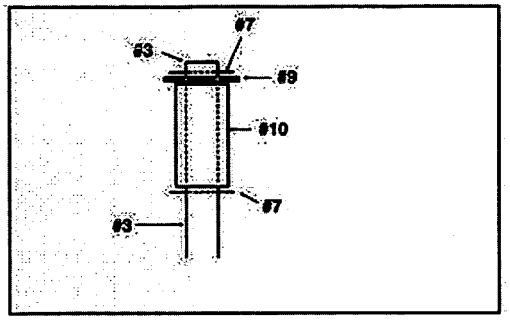
Figure 3:
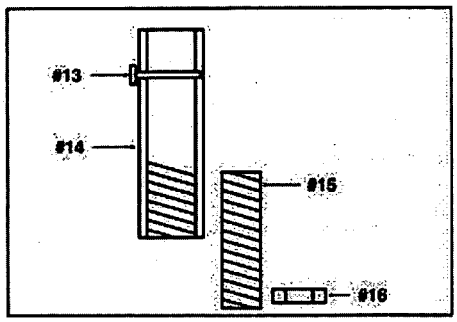
Figure 1:
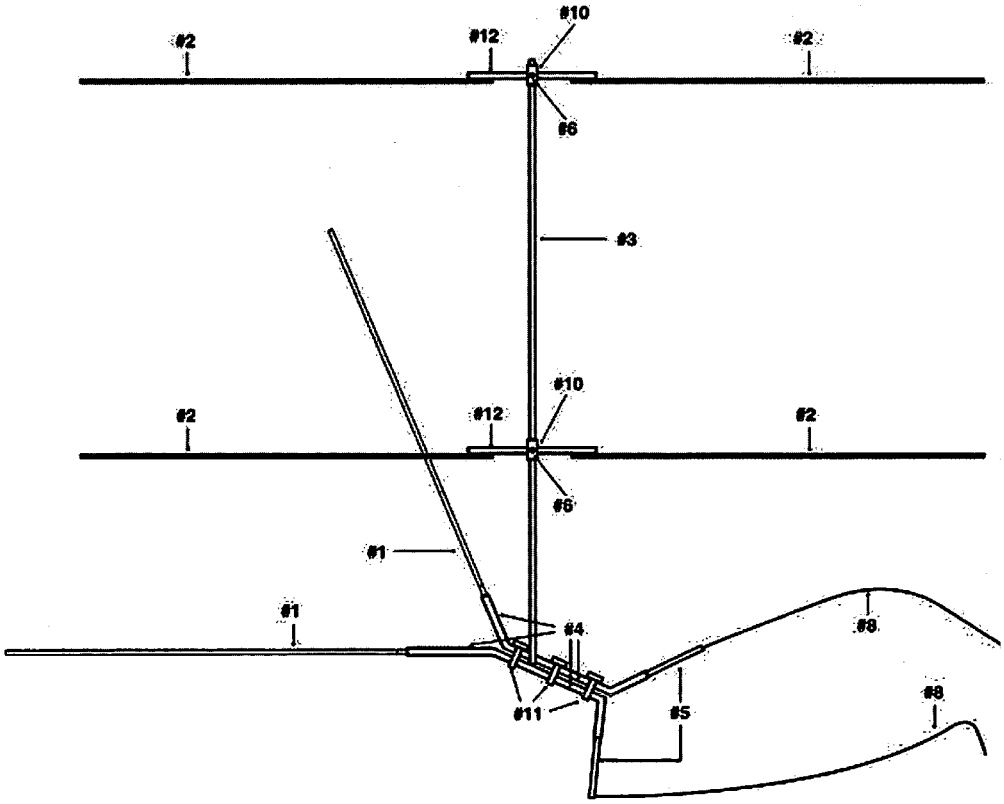
Figure 4:
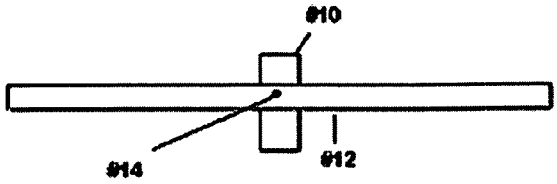
FIG. 4 shows a side view of the Hub of the Rotor.
Figure 5:
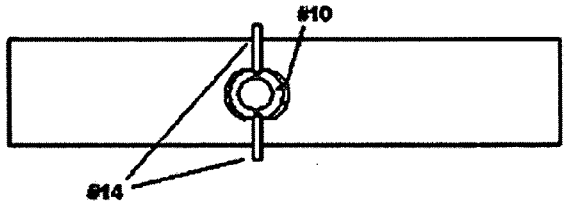
FIG. 5 shows a top view of the Hub of the Rotor.
Figure 6:
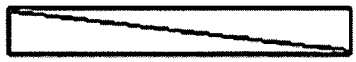
FIG. 6 shows an end view of the Hub of the Rotor.
Figure 7:
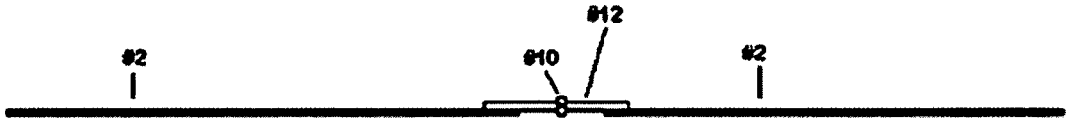
FIG. 7 shows a full side view of the full Rotor.
Figure 8:
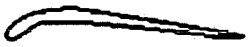
FIG. 8 shows an edge view of a Rotor Blade.

Every part of this invention is made up of parts whose weights are as light as possible and the material as strong and durable as possible. Aluminum tube for the base #4 and carbon fiber for the leg extensions #1 and the control bar extensions #5 and the mast #3. The fasteners for the two base pieces are bolted together with very light aluminum machine screws #11. The bottom of the mast fitting and its parts #13, # 14, #15 and #16 are also made from very light aluminum. The washers #9, that are used on top of the sleeve bearings of each rotor is aluminum and only the half inch long 0.030 OD length of wire is steel and we may yet use aluminum wire here even for this very small part.

Lightness is of great importance in an apparatus of this type that is utilizing what is known as the principal of autorotation. Autorotation is the action of the wind, whether it is the flying machine moving through the wind or the wind blowing against the flying machine. An example of an unpowerd flying machine moving through the air would be a helicopter whose engine has gone out and the pilot puts the rotors into a negative pitch attitude and this enables the rotors to spin as the helicopter comes down to earth and with a proper flare at the end to land safely. In the case of the Plottner Rotor Kite, the rotor kite is basically stationary and the wind must be blowing at the proper speed to create the rotor spin which then creates lift and the end result of flight that happens.

The rotors are designed to spin fast enough in the desired wind (9 miles per hour or better) to create the amount of lift needed to propel the unit into the air. The rotors on the Plottner Rotor Kite are made of light yet very strong Poplar wood, both #2, the rotor blades, and #12 the hubs, are made from this material and it produces a rotor that is strong and durable and yet one that can easily be repaired when damage occurs. The sleeve bearing #10 held inside the hub #12 is made from a suitable hardwood dowel of 0.500 OD with a 0.250 hole drilled through it's center for it's fit onto the mast #3.

The two rotors are held in place on the mast with the short wires #7 which are bent after inserting through 0.050 holes drilled at the 6 inch mark above the base and also near the top of the mast. An aluminum washer is used on the mast #3 just above each rotor and just below the top pin #7. The holes in the hubs #12 which accept the sleeve bearings #10 are made slightly oblong to allow the rotors to teeter as they spin on the mast #3. The teeter angle of each rotor should be no more then 5 degrees. Both rotors must be able to spin with a several inch clearance between the two rotors tips even with the teeter at maximum on each rotor. The bottom rotor is also given extra clearance by the proper bending of the leg and control bar sections of the base #4 which will allow both the leg extensions #1 and the control bar extensions #5 to be slanted downward from the base at perhaps a 10 degree angle which gives a adequate clearance to the bottom rotor so far as the base #4 and its attachments are concerned.

The rotor blades #2 are 24 inches in length and their top surface is shaped to a normal airfoil shape as depicted at the bottom of drawing two. The underneath side of each blade is also brought to a concave shape as shown in the drawing. The end result is a special type of rotor blade that not only has the highest revolutions per minute count but also adds to the lightness and therefore better fly ability of the unit because of the removal of material from the bottom of the rotor blades. These rotors can more easily be brought to a perfect balance, which is of vital importance, by the simple sanding of the heavier blade. These blades are shaped with a portable sander that is clamped to a stand but we look forward to being able to mould them from some type of plastic material that would be as durable as the Poplar wood.

We have found that Jute Twine #530 is a good choice for control lines. The control lines are fastened to the control bar extensions #5 with a short piece of friction tape wound tightly over the line and the end of the control bar extension. Two tight wraps of the tape and then bring the excess ½ inch of twine back over the tape and two more wraps will do the job. There can be a considerable pull on these lines in the heavier winds so good tension on the tape is needed as the wrap is being done. Another important aspect of using the right type of control line #8, is the troublesome aspect of the blowing wind and the spinning rotors causing the control lines to get wrapped up on the rotors and the mast. It is possible for one to spend all their time unraveling control lines rather then flying the rotor kite if this happens. This Jute Twine and the way you handle it can prevent the just mentioned calamity from happening. First of all always have the control lines wound on a wooden board of at least 12 inches in length. Always keep the control lines downwind of the rotors until actual flight is to happen. Another good idea is to have a short stake in the ground around which you can loop the control lines and have them stretched out to the kite with no slack. When you get into the stronger winds of 14 miles per hour and greater the wind can become of great concern.

We believe this invention to be vastly superior to any others that we have encountered. The stacked counter revolving rotors is a vast improvement in flying ability and stability and we believe produces a superior gyroscopic affect that tends to lend great stability to this invention. The shape of the rotor blades is also of great importance and the fact that this rotor kite requires no weights on the leading edge of the blades adds to the simplicity of this overall design. The legs and leg extensions #1 add greatly to the balance and fly ability of the Plottner Rotor Kite. First of all they allow the rotor kite to take off and land with the rotors completely safe from harm of the spinning rotors hitting the ground. Secondly these same legs add great stability to the unit and allow it to be handled much more easily when it is flying. If one removes the leg extensions they will find that, while the rotor kite can be handled by a skilled flyer, it will not have near as much stability as it does with the legs attached and control will be difficult. Actually the inventor has flown the rotor kite in the no leg configuration and it is possible in this configuration to let go of the control lines and have the rotor kite come down in a pure autorotation manner with it landing upright and no harm done to the spinning rotors. The reason this can happen is that with the leg extensions removed the rotor kite now has the center of gravity in front of the center of pressure and this lends greatly to the unit coming down in a vertical manner. We do not recommend this kind of flying to the inexperienced.

We offer the following advice to flyers of the Plottner Rotor Kite. Before flying make sure that the base bolts are properly tightened and the same for the mast fitting at the base. Double check the balance of each of the rotors as an out of balance rotor will ruin most any effort of flight. Be sure to put a drop or two of oil (regular 10-30 motor oil will do fine) on the surface of the mast where the sleeve bearing will be rotating. To fly the Plottner Rotor Kite lets hope for a steady wind of 12 miles per hour. In many cases the wind will be erratic in both speed and direction and both of those elements will make flying a bit more difficult. My experience tells me that the best winds are found on the downwind side of any large body of water with the best of course being one of our coastal oceans. A key thing to remember is that if and when the wind drops to that needed for flight, which in this case is in the vicinity of 9 miles per hour, then the rotor kite will simply drop to the ground and sometimes these fickle winds can drop very suddenly. So it is wise to become very familiar with the wind.

Unravel your control lines and then lay them out on the ground upwind of the rotor kite and attach the looped end to a short stake in the ground. Now take the rotor kite and set it on its legs such that the rotors are very near in a vertical position. In this near vertical position they will be most affected and caused to spin with the oncoming wind coming up and through the blades from the bottom of the rotor kite. With a control line #8 in each hand step backwards from the rotor kite about ten feet, all the while keeping the unit sitting on its legs with the rotors near vertical and the control lines lightly gripped in your hands. When you first set the rotor kite on its legs to begin flying it is a good idea to give first the top and then the bottom rotor a spin with your hand to get the rotors initially spinning. Like a car starting from a dead standstill so is a rotor blade on a rotor kite. When you are back about ten feet and with the control lines gripped more tightly the wind will now have a clearer path to spin the rotors and depending on the wind speed may be ready to fly by the time the operator steps the ten feet off. With the rotors spinning briskly the operator now pulls both control lines toward his body, which will bring the rotors into a more horizontal position, and the rotor kite will either gently or suddenly leap into the air depending on the strength of the wind. It is important to remember that for the most efficient control of the rotor kite keeping the arms widely extended width wise is the most important position. In the stronger winds this is a must and less so when flying in winds that never get over 11 miles per hour or thereabouts. The rest of the flying skills must be learned from experience and then one will find that they can produce a bit of relative wind themselves by running backwards with the rotor kite in the air to give it added lift and also to run forward with the rotor kite to reduce the relative wind and therefore induce the rotor kite to come down. There are also sideways maneuvers that one can do but all of this is in the realm of practice and experience.

We have found that the overall basic design that we have come up with here can be duplicated to a very great extent in the building of both smaller and much larger rotor kites. We have flown units to date with rotor blade lengths of 29 inches, 50 inches, 80 inches and 113 inches, all with simply the appropriate larger members of the individual parts and a few other additions. We therefore believe that the patent for the Plottner Rotor Kite cover all sizes of rotor kites that can be built from the basic design represented here. We have videos we have taken of all of these sizes in flight at this date of Oct. 26, 2004.

I claim:

1. A rotor kite comprising:

a base portion that supports two control bars that extend forwardly of the base and are connected to two control lines of the rotor kite for maximum control in both light and heavy winds;

said base portion further supports two counter rotating rotors on a single mast that extends vertically from said base portion and produces a maximum lift to allow said rotor kite to be launched from a sitting position on the ground;

said base portion further supports two light weight legs whose ends are spaced laterally and to the rear of said base portion such that the rotor kite can sit on the ground and be ready for takeoff with said rotors spinning in their vertical position with little worry of said counter rotating rotors hitting the ground and causing damage;

and wherein the front ends of said control bars where the two control lines are attached are positioned forward of both a center of gravity of the rotor kite and a center of pressure of the counter rotating rotors and said light weight legs are positioned rearward of both a center of gravity of the rotor kite and a center of pressure of the counter rotating rotors for enhanced stability and control.

2. A rotor kite as claimed in claim 1 and further comprising that said counter rotating rotors made from solid hardwood and not balsa, and very durable.

3. A rotor kite as claimed in claim 1 and further comprising that said control bars are made of light weight carbon fiber.

* * * * *